US007353855B2

(12) United States Patent
Collishaw

(10) Patent No.: US 7,353,855 B2
(45) Date of Patent: Apr. 8, 2008

(54) AWNING HEAD ROD MOLDING AND ASSEMBLY

(76) Inventor: Charles Collishaw, One Lori Ct., Spring Valley, NY (US) 10977

( * ) Notice: Subject to any disclaimer, the term of this patent is extended or adjusted under 35 U.S.C. 154(b) by 308 days.

(21) Appl. No.: 11/189,476

(22) Filed: Jul. 27, 2005

(65) Prior Publication Data

US 2006/0237143 A1 Oct. 26, 2006

Related U.S. Application Data

(63) Continuation-in-part of application No. 29/228,154, filed on Apr. 21, 2005, now Pat. No. Des. 539,440.

(51) Int. Cl.
*E06B 7/14* (2006.01)

(52) U.S. Cl. ..... 160/44; 160/47; 52/11

(58) Field of Classification Search ..... 160/54, 160/56, 67, 44, 391, 392, 395, 40, 47, 45; 248/273; 52/11, 15, 74; 135/88.11, 88.12; 296/163, 208

See application file for complete search history.

(56) References Cited

U.S. PATENT DOCUMENTS

| | | | | |
|---|---|---|---|---|
| 1,813,525 | A | 7/1931 | Astrup | |
| 2,787,321 | A | 4/1957 | Dietz | |
| 2,799,464 | A | 7/1957 | D'Azzo | |
| 3,478,806 | A | 11/1969 | Darula | |
| 3,720,438 | A | 3/1973 | Johnson et al. | |
| 3,825,023 | A | 7/1974 | Bergeron | |
| 3,851,848 | A * | 12/1974 | Wiele | 248/273 |
| 4,077,419 | A | 3/1978 | Lux | |
| 4,158,244 | A | 6/1979 | Stefan | |
| 4,924,895 | A | 5/1990 | Bailie | |
| 5,433,259 | A | 7/1995 | Faludy | |
| 5,560,411 | A | 10/1996 | Becker | |
| 5,622,214 | A | 4/1997 | Baka et al. | |
| 6,279,641 | B1 | 8/2001 | Malott | |
| 6,782,939 | B2 | 8/2004 | Perks | |
| 2004/0182013 | A1* | 9/2004 | Kehrer | 52/11 |

* cited by examiner

*Primary Examiner*—David Purol
(74) *Attorney, Agent, or Firm*—Michael E. Zall

(57) ABSTRACT

A head rod molding and awning system adapted to be mounted above or below the roof line. The head rod molding member comprises an elongated member having an upper edge and an opposite lower edge along its length. A guideway is provided on the front side of the elongated molding member between the upper and lower edges. A forwardly disposed overhanging lip is provided along the upper edge and a channel, preferably substantially cylindrical, is running along the lower edge, the channel have having a slot along the length of the channel.

2 Claims, 5 Drawing Sheets

AWNING HEAD ROD MOLDING AND ASSEMBLY

RELATED APPLICATIONS

This application is a continuation in part application of U.S. application Ser. No. 29/228,154 filed on Apr. 21, 2005 now U.S. Pat No. D,539,440 the entire disclosure of which is incorporated herein by reference.

BACKGROUND OF THE INVENTION

1. Field of the Invention

The invention relates to patio awnings, and more particularly to a molding for mounting the head rod of an awning and the rafters or awning supporting rods thereon. In particular, this invention relates a head rod molding which provides a continuous grooved support for clamps to hold the head rod and canvas assembly on a common mounting both above and below the roof line.

2. Description of the Related Art

The invention described and claimed herein is directed to a novel head rod molding for awnings mounted to buildings.

A commercially known awning mounting system is depicted in FIG. 1. In this system the head rod molding HARM is mounted below the gutter on the side of the house S through bolts B. The head rod HR. is passed through a hem H at the top of the awning A and is mounted below the lip LP of the head rod molding HARM. The head rod HR. is held by finger clips (not shown) mounted in the guide way C of the head rod molding HARM. The awning A is stretched over rafter fittings R that are also mounted in the guide way C.

U.S. Pat. No. 3,478,806 to Darula describes such a system for mounting the head rod of a stationary or patio awning in greater detail. The molding is an extrusion of aluminum having a flat rear surface, an overhanging rainproof lip at its upper end and a guide way or track on its front side below the lip. Finger clips are adjustably mounted upon the track or guide way by means of carriage bolts having thumb nuts thereon and are adapted to be tightened to hold the head of the awning under the overhanging lip. The rafters of the awning are pivotally attached to jaw ends provided with carriage bolts riding laterally in the same track or guide way on which the finger clips are mounted.

For various reasons, it may be desirable to mount the awning head rod above the roof line. The aforedescribed system cannot effectively be mounted above the roof line because rain water will fall below the awning and/or water coming from the roof will overflow the gutters and fall below the awning, thus defeating the purpose of having an awning, i.e., to protect those under it from the elements.

The invention described and claimed herein has the advantage of permitting the awning head rod molding to be mounted either below or above the roof line.

Other prior art references of interest are the following U.S. patents:

U.S. Pat. No. 2,799,464 to D'Azzo shows canopy and awning molding and supports with a clamp bar formed with a terminal concave jaw to engage the fabric tube which encloses the head rod. The ceiling wing is formed with a longitudinal concave or semicircular seat, which snugly receives the fabric covered head rod. The molding has a "ceiling section" that extends perpendicular from the building engaging wall section.

U.S. Pat. No. 2,787,321 to Dietz shows a head rod holder with an awning having an inner edge portion with a hem or pocket in which there is a removably mounted a rod.

U.S. Pat. No. 5,560,411 to Becker describes a header rail for mounting an awning having an awning rope and rafter arms to a building wall having siding with outwardly extending laps. The header rail includes an extrusion having a front wall and a pair of legs extending from the front wall. The legs have generally co-planar building wall engaging surfaces and space the front wall from the building wall to form a longitudinally extending interior space sized for accepting one or more of the siding laps. The front wall forms in cross-section a longitudinally extending awning rope retainer and a longitudinally extending guide way. Rafter extensions are provided to slide into the guide way and pivotally connect the rafter arms.

U.S. Pat. No. 6,782,939 to Perks describes a plastic door made from rigid plastic panels that hingedly secure to one another by a lateral slide interlock at adjacent edges of the panels.

U.S. Pat. No. 6,279,641 to Malott describes a retractable awning assembly that includes a roller, arm assemblies supporting ends of the roller, an awning rail securable to a support wall, a flexible canopy rollable on the roller and having an outer edge secured to the roller and an inner edge connected to the awning rail, and an articulated protective cover connecting the flexible canopy to the awning rail.

U.S. Pat. No. 5,622,214 to Baka et al describes an improved awning assembly for a recreational vehicle that has the awning rolled around a roller tube.

U.S. Pat. No. 5,433,259 to Faludy describes a retractable awning that includes a weather protective articulated slat system for protecting the awning when in a retracted position with a solar cell panel incorporated into an articulated slat and connected to a battery for charging the battery.

U.S. Pat. No. 4,924,895 to Bailie describes a cover adapted to surround and protect a fabric awning when rolled to the stored position.

U.S. Pat. No. 4,158,244 to Stefan describes a pool liner retainer for holding or retaining the top peripheral edge portion or liner bead of a watertight pool liner, such as is used in swimming pool construction.

U.S. Pat. No. 4,077,419 to Lux describes an awning apparatus for travel trailers and mobile homes for canopy awnings having a canopy attached at a fixed rail on the vehicle and at a wind-up roller bar.

U.S. Pat. No. 3,825,023 to Bergeron describes a rolled trailer awning retaining device having a C-shaped aluminum strap.

U.S. Pat. No. 3,720,438 to Johnson et al describes an awning for a camper or trailer or similar vehicle.

U.S. Pat. No. 1,813,525 to Astrup describes an awning bracket.

None of these references teach or suggest the head rod molding and awning assembly of this invention.

OBJECTS AND SUMMARY OF INVENTION

It is an object of this invention to provide a head rod molding that is suitable for mounting an awning head rod either below or above the roof line.

It is yet another object of this invention to provide a head rod molding for mounting an awning head rod above the roof line and gutter and still provide protection from the rain and gutter spillover.

It is also an object of the invention to provide a head rod molding suitable for mounting an awning head rod either below or above the roof line and which is easy to manufacture and use.

All of the foregoing objects as well as others are achieved by the head rod molding and awning system of this invention.

The head rod molding member comprises an elongated member having an upper edge and an opposite lower edge along its length. A guide way is provided on the front side of the elongated molding member between the upper and lower edges. A forwardly disposed overhanging lip is provided along the upper edge and a channel, preferably substantially cylindrical, is running along the lower edge, the channel having a slot along the length of the channel.

The awning system is of this invention is mountable to a roof having a gutter. The system comprises an elongated head rod molding member having an upper edge and an opposite lower edge along its length. A guide way is provided on the front side of the elongated molding member between the upper and lower edges. A forwardly disposed overhanging lip is disposed along the upper edge of the molding member and a channel is provided along the lower edge. The channel is preferably substantially cylindrical and has a slot along the length of the channel. A plurality of awning rafters for mounting an awning thereon is provided along with a means for slidably and pivotally mounting the awning rafters in the guide way. An awning is attached to the rafters. The awning has a hem at its upper edge and a first head rod in the hem. A mounting means is provided that is slidable in the guide way and is used for clamping the head rod beneath the overhanging lip. A flexible sheet material is provided that has a hem at its upper edge. A second head rod is in the hem, the second head rod and surrounding hem matable into the channel with the sheet material hanging through the slot. A means is provided for mounting the head rod molding along an edge of the roof above the gutter for mounting the awning thereto, the sheet material hanging into gutter to guide rain water into the gutter.

BRIEF DESCRIPTION OF THE DRAWINGS

For a more complete understanding of the present invention, reference may be had to the following description of the exemplary preferred embodiments of the present invention considered in connection with the accompanying drawings, of which.

DETAILED DESCRIPTION OF THE INVENTION

Figure 1:
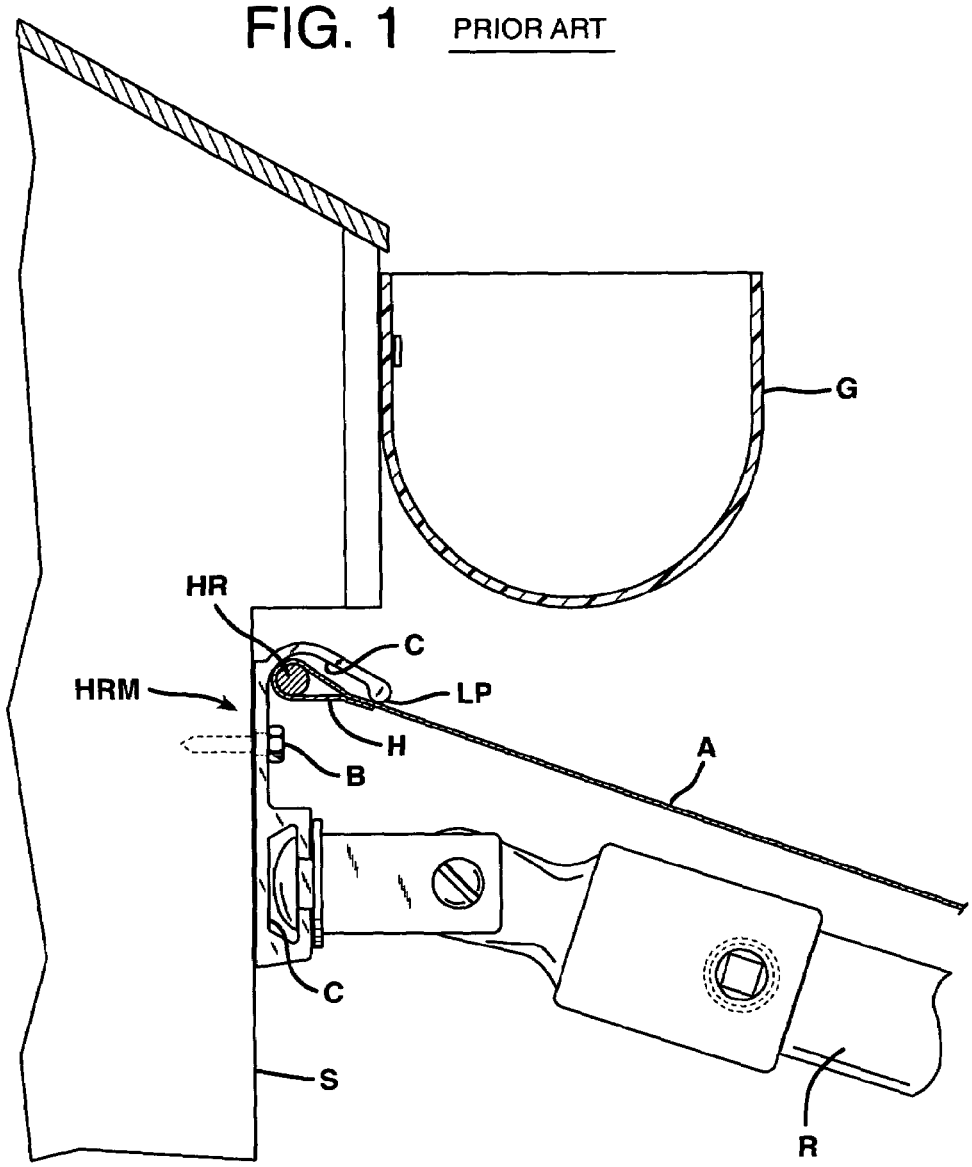
FIG. 1 PRIOR ART
FIG. 1 is a side view of a commercially available Prior Art awning head rod molding and awning mounting assembly.

Referring now more particularly to the embodiment illustrated in FIGS. 2-5, in which similar parts are designated by similar reference numerals. A head rod molding 10 is provided which is an elongated extrusion formed of aluminum or similar metal.

The rear surface 12 is flat and smooth, and at the upper edge of the molding is provided an overhanging rainproof lip, indicated generally at 14, having an upwardly and forwardly curved portion 16 and the downwardly and forwardly inclined portion 18 with enlarged bead 20 at its forward edge. This forms a longitudinal recess 22 at the top of the molding.

Spaced below the overhanging lip 14, on the front face of the molding 10, is formed a track or guide way 24 for adjustably mounting finger clips (not shown) for clamping the head rod 26 for the awning 28 in the molding 10 and also jaw ends 30 for pivotally connecting the upper ends of the rafters or awning supporting rods 32.

Figure 2:
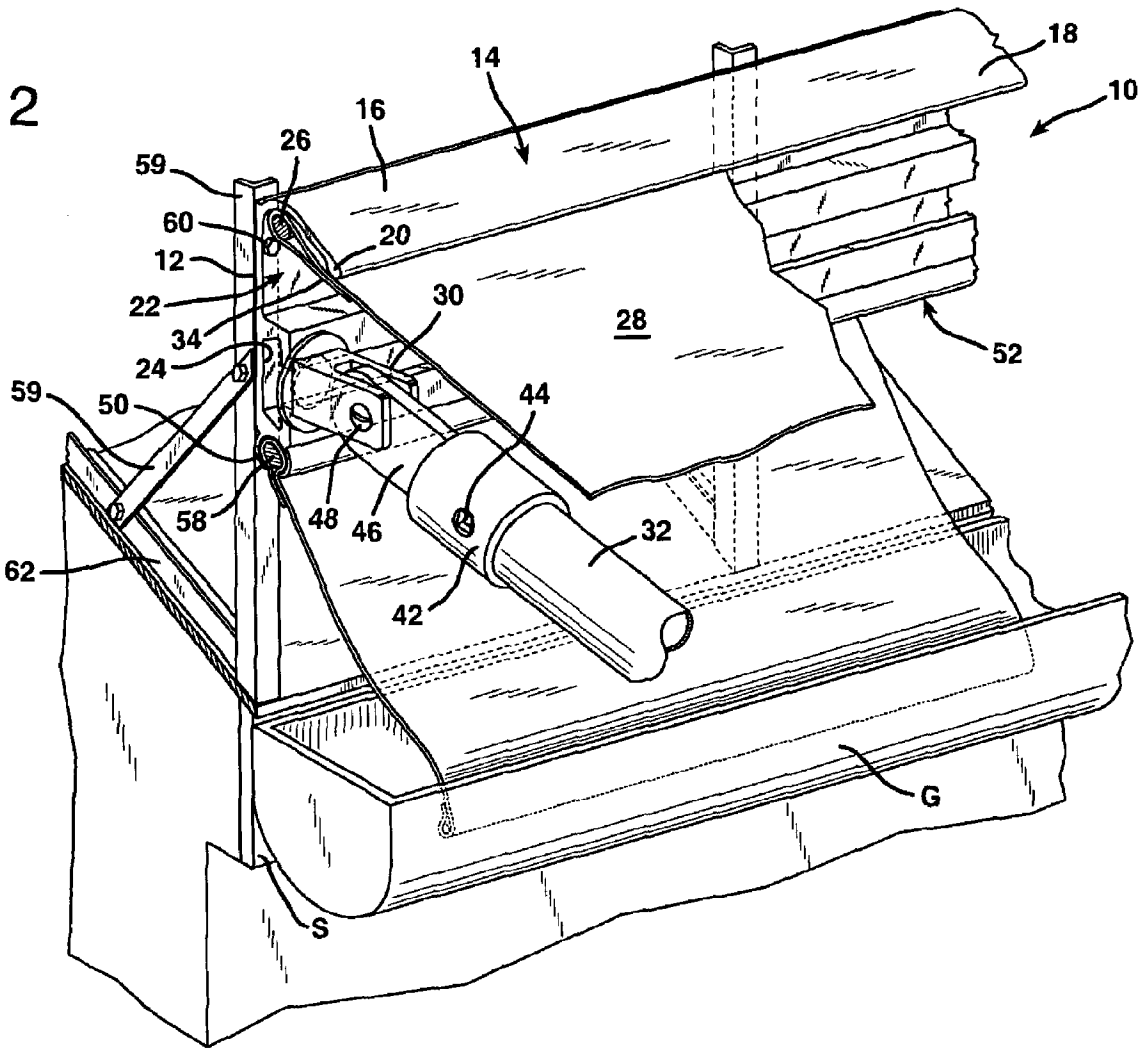
FIG. 2 is a perspective view of the awning head rod molding of this invention in use in an awning mounting assembly mounted above the roof line.

The awning 28 has a head hem or casing 34 formed at its upper end within which is located the head rod 26. As best shown in FIG. 2, the head rod 26 is held in position beneath the overhanging lip 14 by means of finger clips (not shown) which are located at spaced intervals throughout the length of the molding 10. A carriage bolt is located through an aperture in the lower portion of each finger clip securing it in the guide way 24. The carriage bolt is located within the track or guide way 24 and when the same is properly adjusted laterally within the guide way 24 clamping the finger clip in position, to clamp the head rod 26 against the curved under portion of the lip 14, see U.S. Pat. No. 3,478,806 to Darula, incorporated herein be reference.

Figure 3:
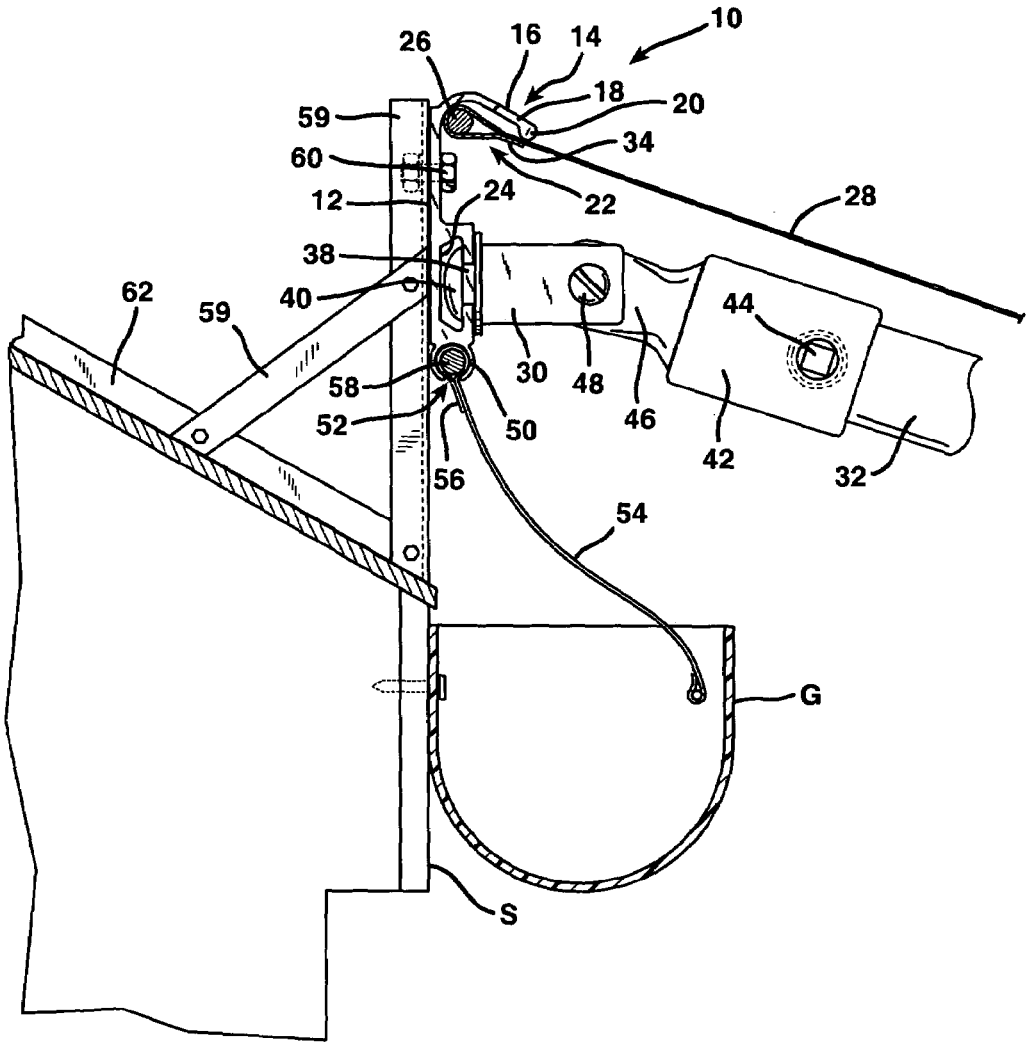
FIG. 3 is side view of the awning head rod molding and awning mounting assembly of this invention shown in FIG. 2.

Referring to FIGS. 2 and 3, jaw ends 30 are laterally adjustably mounted upon the molding 10 by means of carriage bolts 38 the heads 40 of which are located in the track or guide way 24. Caps 42 are fixed upon the upper ends of the rafters or awning supporting rods 32, as by set screws 44, and each has an ear 46 pivotally mounted between the jaw ends 30 as by bolt 48.

The head rod molding 10 additionally has a cylindrical channel 50 running along the lower edge. The channel has a slot 52 throughout its length. A flexible sheet material 54 is provided that has a head hem or casing 56 having formed at its upper end within which is located a second head rod 58. The second head rod 58 is snapped or threaded through channel 50, with the sheet material 54 passing through the slot 52. The sheet material 54 is of sufficient length that when the molding 10 is mounted above the roof line, as shown in FIGS. 2-3, the material is suspended in the gutter G.

Figure 4:
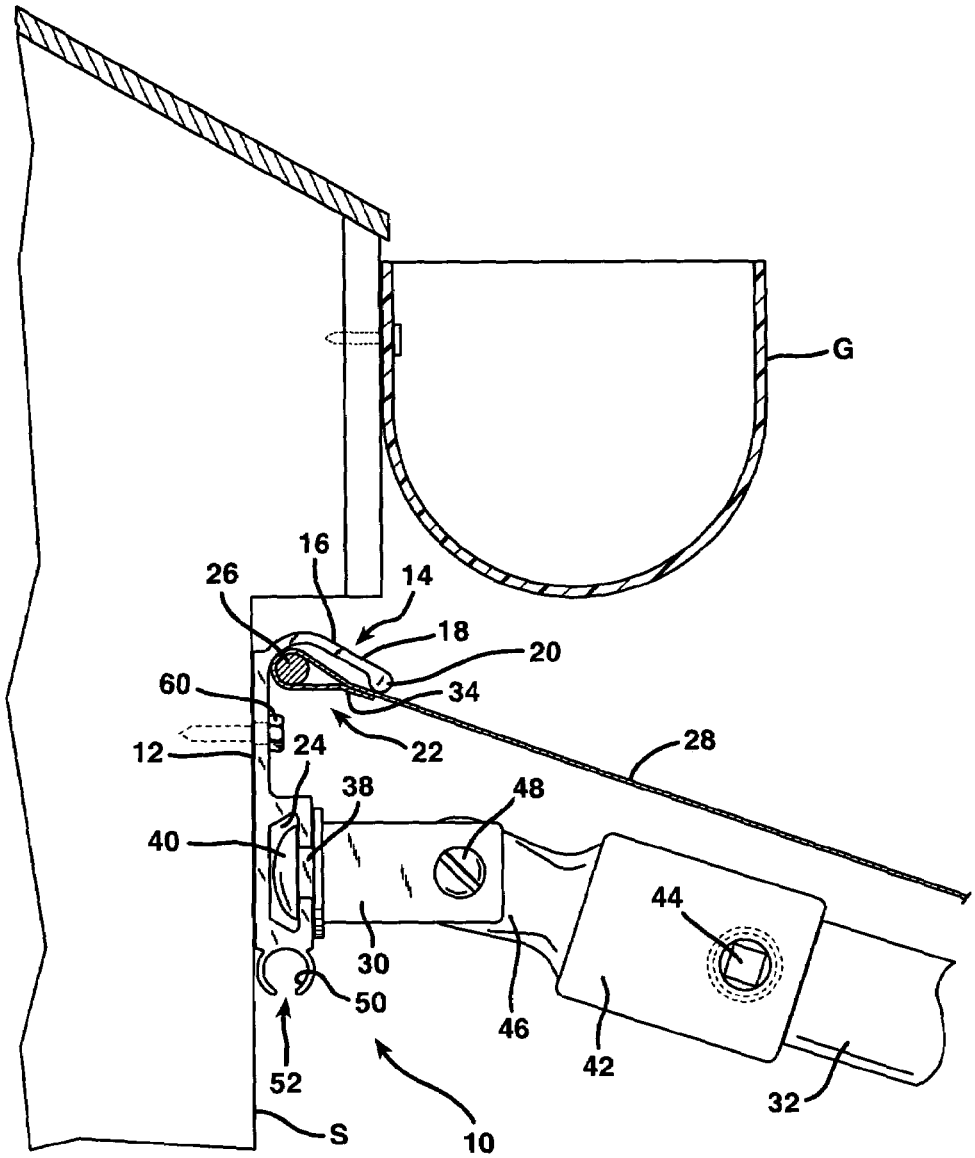
FIG. 4 is side view of the awning head rod molding of this invention mounted in the conventional manner below the gutter.
Figure 5:
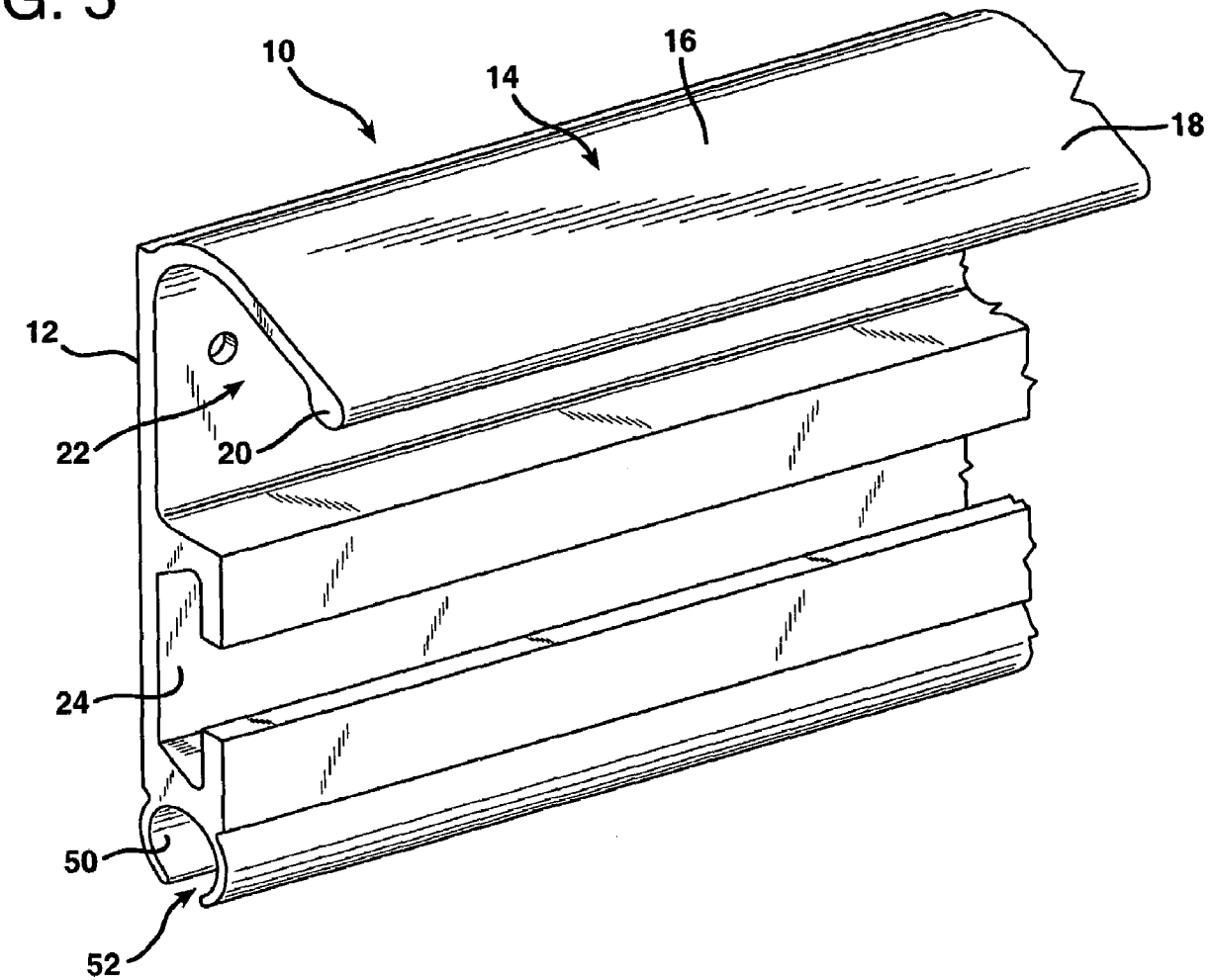
FIG. 5 is a perspective view of the awning head rod molding of this invention used in the awning mounting assembly shown in FIGS. 2-4.

A unique advantage of this invention is that it may be mounted in the known manner (see FIG. 1 and in U.S. Pat. No. 3,478,806 to Darula) as shown in FIG. 4. Specifically, the molding may be mounted upon a side wall S, by bolts 60 which may be placed at desired intervals throughout the length of the molding 10. In order to prevent any leakage of moisture between the back of the molding 10 and the wall S a bead of caulking compound may be located at the top edge of the molding 10 where it meets the wall. The molding 10 may be placed below the gutter G, as shown in FIG. 4, with any spillover from the gutters spilling onto the top of the awning 28.

Optionally, as depicted in FIGS. 2 and 3, the molding may be mounted above the roof line. If mounted in this manner, the head rod molding 10 is horizontally mounted on vertical struts or angle irons 59 projecting above the roof line the desired height. The struts 59 may be supported by roof struts 62 and angle irons 59. When supported above the roof line in this manner, the flexible sheet material 54 is provided that has a head hem or casing 56 having formed at its upper end within which is located a second head rod 58. The second head rod 58 is snapped or threaded through channel 50, with the sheet material 54 passing through the slot 52. The sheet material 54 is of sufficient length that when the molding 10 is mounted above the roof line, as shown in FIGS. 2-3, the material is suspended in the gutter G. This prevents the water that flows off the roof and into the gutter from overflowing below the awning. Additionally, it prevents rain water from falling through the space between the molding 10 and the roof line.

From the above it will be obvious that a leakproof installation is provided at the head of a stationary or patio awning when the head rod molding is mounted either above or below the roof line. The foregoing constitutes a description of specific embodiments showing how the invention may be applied and put into use. These embodiments are only exemplary. The invention in its broadest, and more specific aspects, is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure.

What is claimed is:

1. An awning system mountable to a roof having a gutter, the system comprising:

an elongated head rod molding member having an upper edge and an opposite lower edge along its length;

a guideway on the front side of the elongated molding member between the upper and lower edges;

a forwardly disposed overhanging lip along the upper edge;

a channel running along the lower edge, the channel have having a slot along the length of the channel;

a plurality of awning rafters for mounting an awning thereon;

a means for slidably and pivotally mounting the awning rafters in the guideway;

an awning attached to the rafters, the awning having a hem at its upper edge;

a first head rod in the hem;

mounting means slidable in the guideway for clamping the head rod beneath the overhanging lip;

a flexible sheet material having a hem at its upper edge;

a second head rod in the hem, the second head rod and surrounding hem matable into the channel, the sheet material hanging through the slot;

a means for mounting the head rod molding along an edge of the roof above the gutter for mounting the awning thereto;

wherein the sheet material hangs into gutter guiding rain water into the gutter.

2. The awning system of claim 1, wherein the channel is substantially cylindrical.

* * * * *